United States Patent [19]

Brauner

[11] Patent Number: 4,973,810

[45] Date of Patent: Nov. 27, 1990

[54] MICROWAVE METHOD OF POPPING POPCORN AND PACKAGE THEREFOR

[75] Inventor: Arne H. Brauner, Plymouth, Minn.

[73] Assignee: General Mills, Inc., Minneapolis, Minn.

[21] Appl. No.: 375,568

[22] Filed: Jul. 3, 1989

[51] Int. Cl.[5] ..... H05B 6/80

[52] U.S. Cl. ..... 219/10.55 E; 219/10.55 F; 219/10.55 D; 99/DIG. 14; 426/107; 426/234; 426/243

[58] Field of Search ..... 219/10.55 E, 10.55 F, 219/10.55 D, 10.55 M; 426/107, 106, 111, 113, 115, 234, 241, 243; 99/DIG. 14

[56] References Cited

U.S. PATENT DOCUMENTS

| | | | |
|---|---|---|---|
| 3,835,280 | 9/1974 | Gades et al. | 219/10.55 E |
| 4,190,757 | 2/1980 | Turpin et al. | 219/10.55 E |
| 4,448,309 | 5/1984 | Roccaforte et al. | 426/107 |
| 4,553,010 | 11/1985 | Bohrer et al. | 219/10.55 E |
| 4,703,148 | 10/1987 | Mikulski et al. | 219/10.55 E |
| 4,724,290 | 2/1988 | Campbell | 219/10.55 E |

*Primary Examiner*—Philip H. Leung

*Attorney, Agent, or Firm*—L. MeRoy Lillehaugen; John A. O'Toole; Stuart R. Peterson

[57] ABSTRACT

The package for use in a microwave oven includes an expandable paper bag transparent to microwave energy having a susceptor path fixedly associated with one side wall thereof and a patch of microwave reflective material fixedly associated with the opposite side wall, so that when the package is placed in a microwave oven with the susceptor patch lowermost and the microwave reflective patch uppermost, the upper patch reflects at least some microwave energy so as to reduce the amount of microwave bombardment in the upper regions of the paper bag. In this way, the kernels of corn that have been popped and underlie the upper patch are less likely to be scorched.

4 Claims, 5 Drawing Sheets

MICROWAVE METHOD OF POPPING POPCORN AND PACKAGE THEREFOR

BACKGROUND OF THE INVENTION

1. Field of the Invention

This invention relates generally to the popping of popcorn kernels with microwave energy, and pertains more particularly to a method and paper bag package utilizing a susceptor patch and microwave shield.

2. Description of the Prior Art

Generally speaking, shielding is not new as far as microwave cooking is concerned. For instance, U.S. Pat. No. 4,626,641 granted on Dec. 2, 1986 to Richard K. Brown for "FRUIT AND MEAT PIE MICROWAVE CONTAINER AND METHOD" discloses the shielding of the bottom and sides of a paperboard insert containing a food product. A microwave interactive layer or susceptor medium is located above the food for the purpose of converting microwave energy into heat in order to brown and crisp the surface of the food contained in the insert. The patented container is intended to be used for refrigerated or frozen foods, but would be unsuitable for popping popcorn.

Another prior art situation of interest is contained in U.S. Pat. No. 4,567,341 issued ON Jan. 28, 1986 to Richard K. Brown for "SIDE VENTED AND SHIELDED MICROWAVE PIZZA CARTON." In this instance, no susceptor is utilized, even though a shielding material covers the upper portion and sides of the food; the amount of microwave energy entering the food is thus restricted to entering through the bottom of the carton. The carton in this instance, while suitable for heating pizzas, would be unsuitable for popping popcorn kerniels.

SUMMARY OF THE INVENTION

A general object of my invention is to provide a method and package for use in a microwave oven in which the food product is more effectively and completely cooked. More specifically, an aim of my invention is to more efficiently make use of the microwave energy that is available in a microwave oven.

Another object of the invention is to provide a package and method especially suited for the popping of popcorn kernels in that for a given amount of kernels more kernels are fully popped and fewer kernels remain unpopped, thereby increasing the overall volume of the popped product.

Another object is to increase the performance of a conventional susceptor patch when subjected to microwave energy by increasing the overall amount of heat generated by such a patch during a given time period, and also causing the patch to reach its cooking temperature more rapidly than heretofore. In this regard, susceptor materials are prone to losing some of their ability to heat because of the deterioration o "peaking out" of the thin film of deposited metal that occurs during a typical cooking cycle; an aim of the invention is to derive a sufficient amount of heat to complete the popping cycle before the deterioration becomes significant. Stated somewhat differently, an aim of my invention is to decrease the overall heating time required to pop a given quantity of popcorn kernels.

Still further, an object is to avoid overcooking and scorching the already popped corn. Also, the invention has as an aim the minimizing of scorching as far as the paper bag is concerned. When utilizing the teachings of my invention, the shielding can be correlated with the microwave heating of the popcorn to avoid both the scorching of the kernels that have been popped as well as the paper of which the bag is fabricated.

Yet another object is to provide a package of the foregoing character that can be inexpensively fabricated, the increased cost over conventional packages being insignificant when measured in relation to the enhanced results that are derived.

A still further object of the invention is to provide a package for use in a microwave oven that will possess an attractive appearance, as well as efficiently popping the corn.

Briefly, my invention contemplates a method involving the use of a paper bag generally transparent to microwave energy, such as that customarily used when popping popcorn in a microwave oven. Included is a conventional susceptor patch for converting microwave energy into heat, as is customary, so as to pop the popcorn kernels far more efficiently than if no susceptor patch were employed. Aligned above the susceptor patch is a patch of microwave shielding material, such as a metal foil, that is somewhat larger than the susceptor patch so as to provide a region within the bag that is cooler than the lower region where the popping occurs. The popped kernels are in effect buoyed upwardly into the cooler region beneath the foil patch where they are partially shielded from microwave energy that would result in an overcooking and scorching of the popped kernels.

DESCRIPTION OF THE PREFERRED EMBODIMENT

Figure 1:
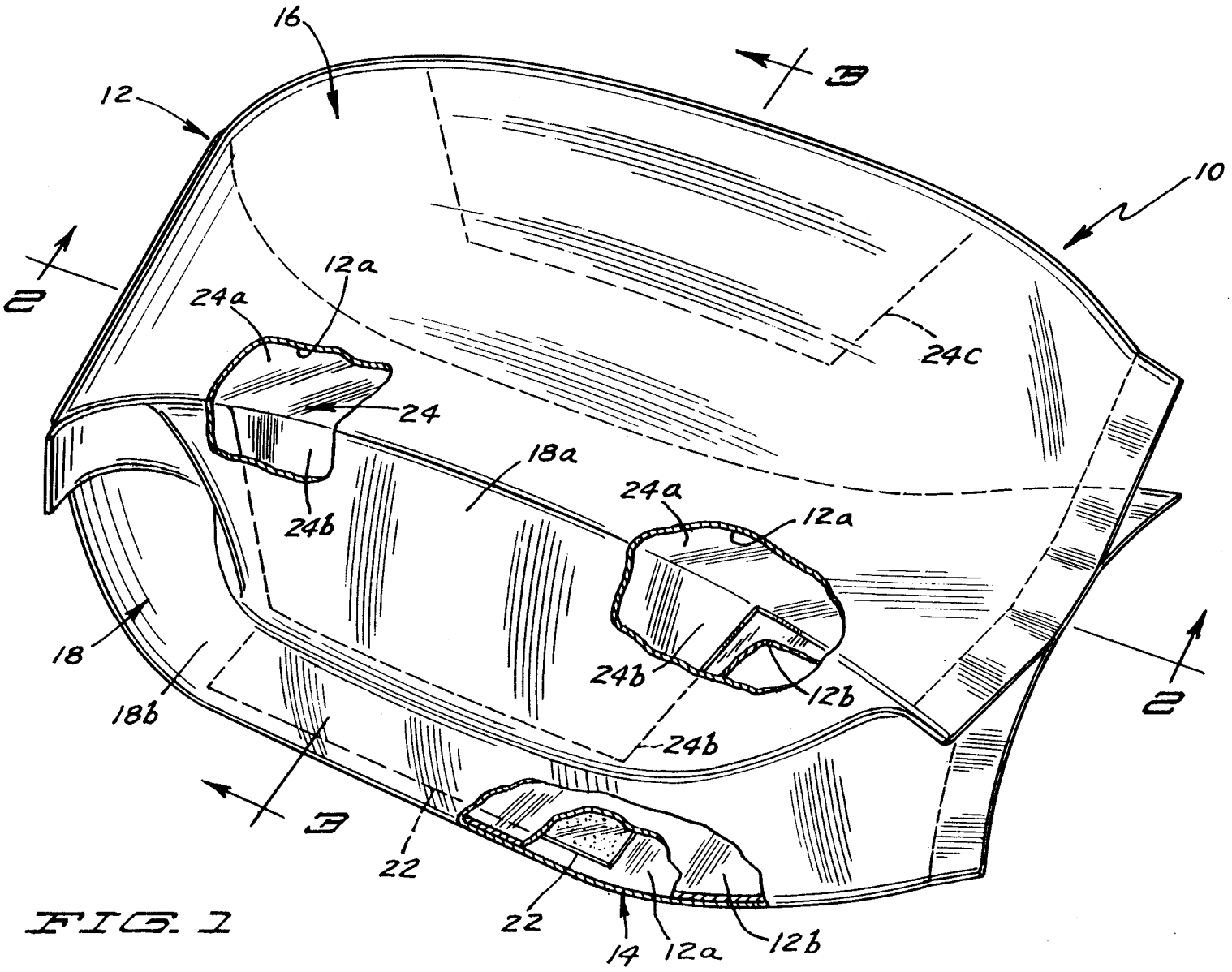
FIG. 1 is a perspective view of my expanded package after the completion of a popping cycle, portions being broken away in order to show the laminated construction of the package.

Referring now to the drawings, the popcorn package illustrating my invention has been indicated generally by the reference numeral 10. The package 10 includes a conventional paper bag 12 fabricated from two laminated layers of paper **12*a* and 12*b*. The basic bag stock used when practicing my invention is not new, so no need exists for depicting the sealed overlap that extends longitudinally along the bag 12**.

Figure 2:
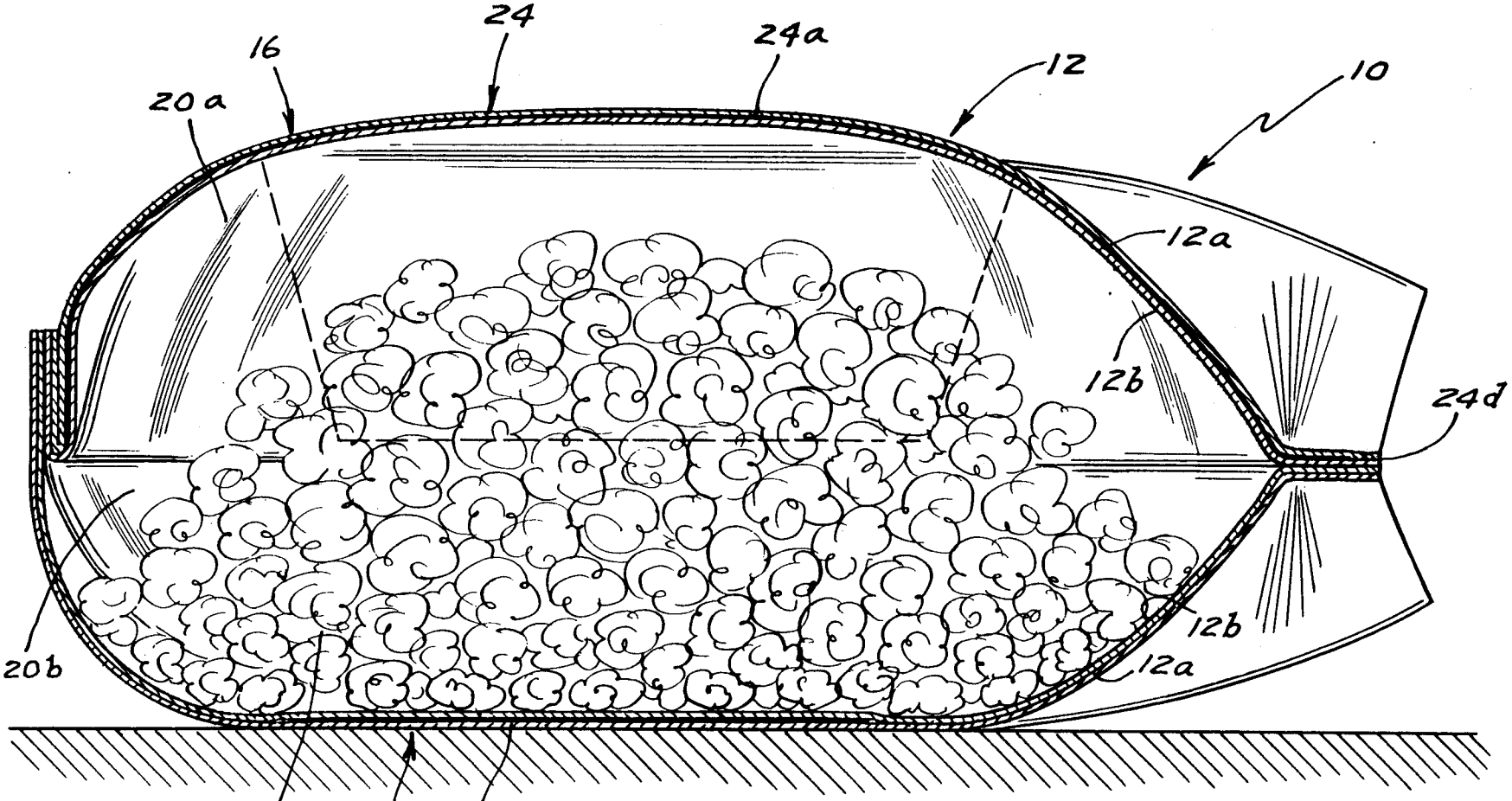
FIG. 2 is a longitudinal sectional view taken in the direction of line 2—2 of FIG. 1.
Figure 3:
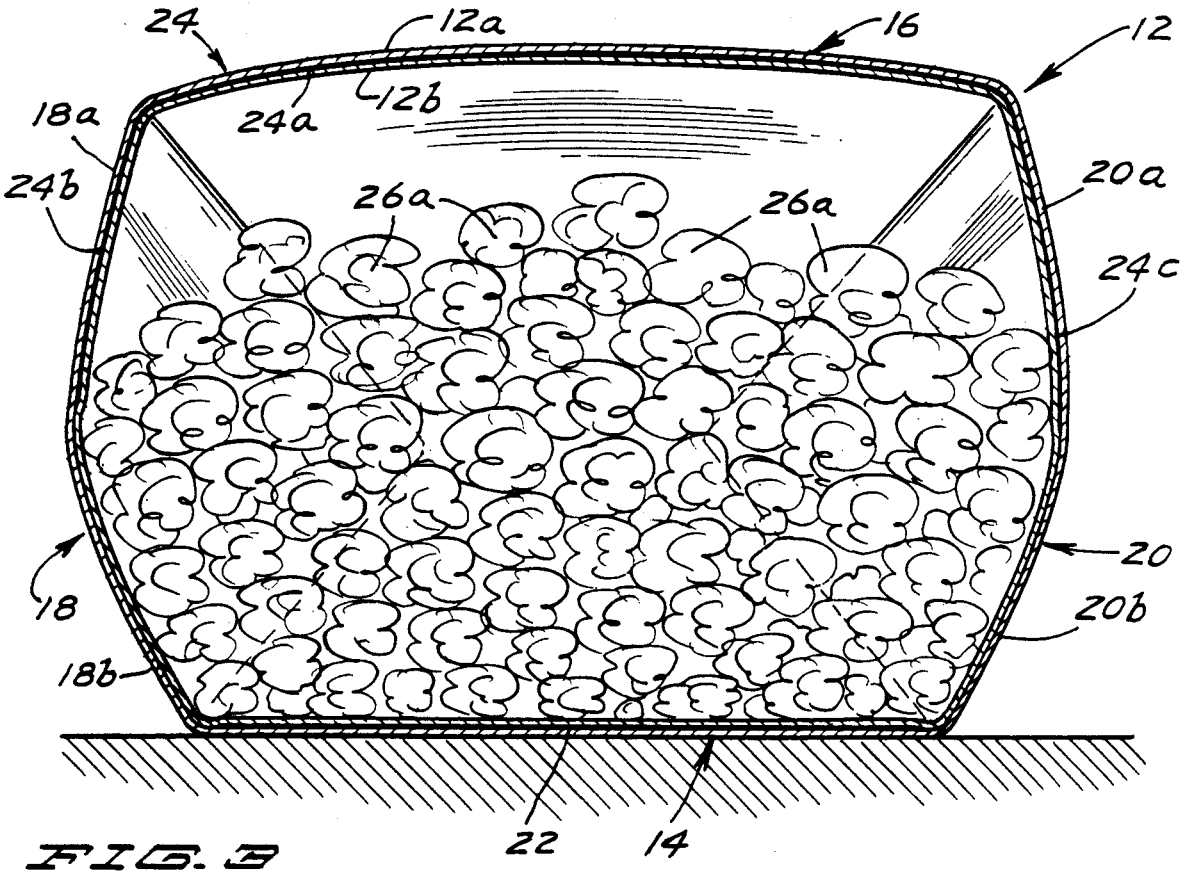
FIG. 3 is a transverse sectional view taken in the direction of line 3—3 of FIG. 1.
Figure 4:
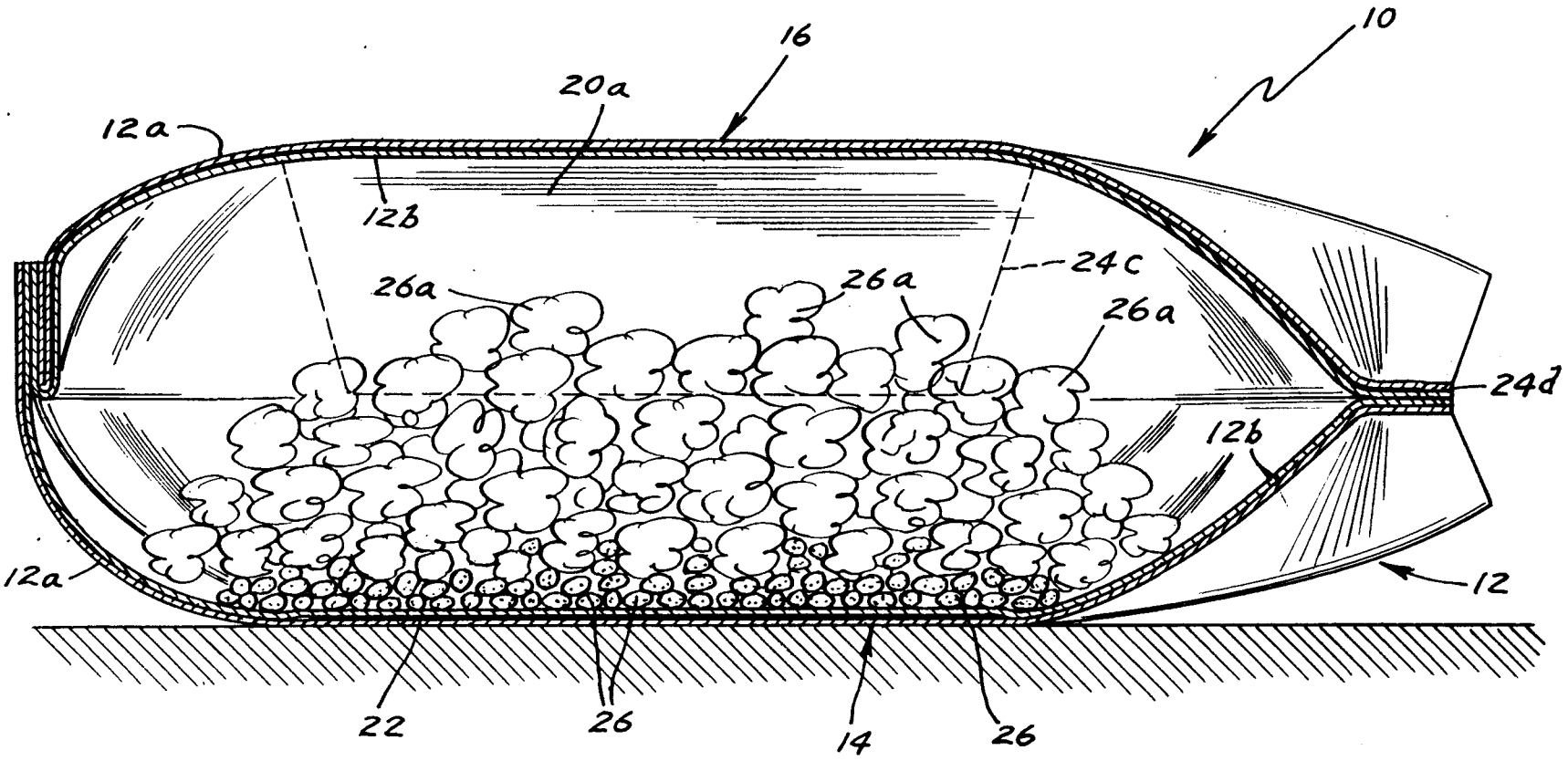
FIG. 4 is a longitudinal sectional view similar to FIG. 2, but illustrating an intermediate stage in the popping cycle where the popping kernels are being buoyed upwardly toward the cooler region that exists beneath the overlying microwave reflective shield, a quantity of soon-to-be popped kernels remaining in the higher-temperature region superjacent the susceptor patch.

It will facilitate the ensuing description to describe the paper bag 12, which is transparent to microwave energy, as having a lower face wall 14, an upper face wall 16 and side walls 18, 20. The side walls 18 and 20 are composed of pleats or gussets 18*a*, 18*b* and 20*a*, 20*b* so as to permit expansion of the bag 12 when subjected to sufficient microwave energy, more specifically, after the completion of a popping cycle. The opposite ends of the bag 12 can be sealed as best understood from a consideration of FIGS. 2, 4 and 7. The specific manner in which the ends of the paper bag 12 are sealed is unimportant to an understanding of my invention.

Although a corner of a metalized susceptor patch 22 can be seen in FIG. 1, the susceptor patch 22 is better observed in FIGS. 2–4, 6 and 7, being shown sandwiched between appropriate portions of the paper layers 12*a* and 12*b*.

The invention contemplates a patch of microwave reflective material 24, such as aluminum foil, also sandwiched between appropriate portions of the paper layers 12*a* and 12*b*, but in an overlying or umbrella-like relation with the susceptor patch 22. As can be most readily appreciated from FIGS. 2 and 3, the microwave reflective patch 24 is larger than the susceptor patch 22, the patch 24 overlying, in the most preferred form, the entire susceptor patch 22. Specifically, the reflective patch 24 comprises an upper panel 24*a*, side panels 24*b* and 24*c*, and an end panel 24*d*. The upper panel 24*a* is substantially coextensive in size with the upper face wall 16, but sandwiched between the paper layers 12*a* and 12*b*, as earlier herein explained. The side panels 24*b* and 24*c* are substantially coextensive with the upper pleats 18*a* and 20*a*, extending downwardly to the fold line where the pleats 18*a* and 18*b*, and the pleats 20*a* and 20*b*, respectively, are integrally joined. It is important that a major portion of the patch 24 overlie a major portion of the patch 22, and it is believed that this relationship is adequately portrayed in the drawings.

Figure 6:
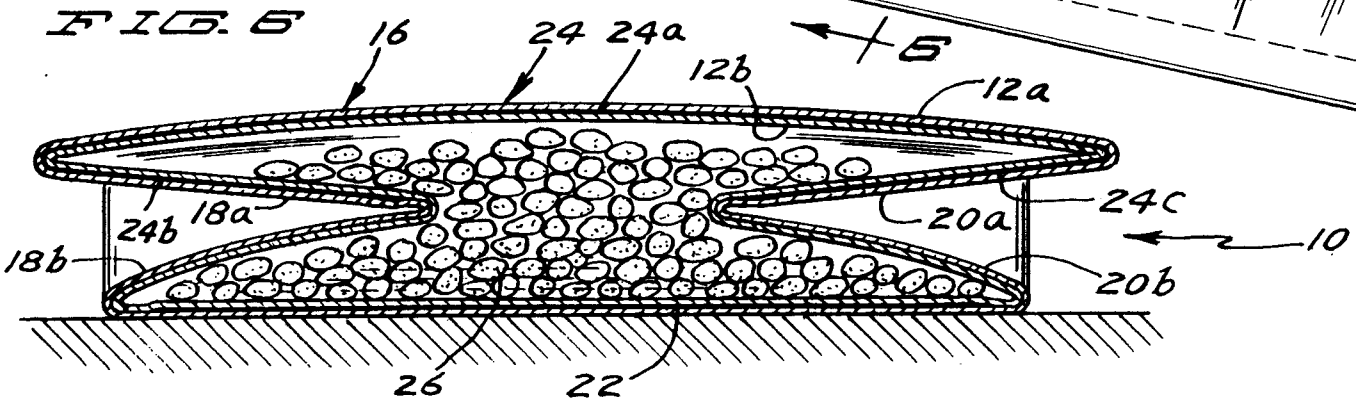
FIG. 6 is a longitudinal sectional view of the package taken in the direction of line 6—6 of FIG. 5.
Figure 7:
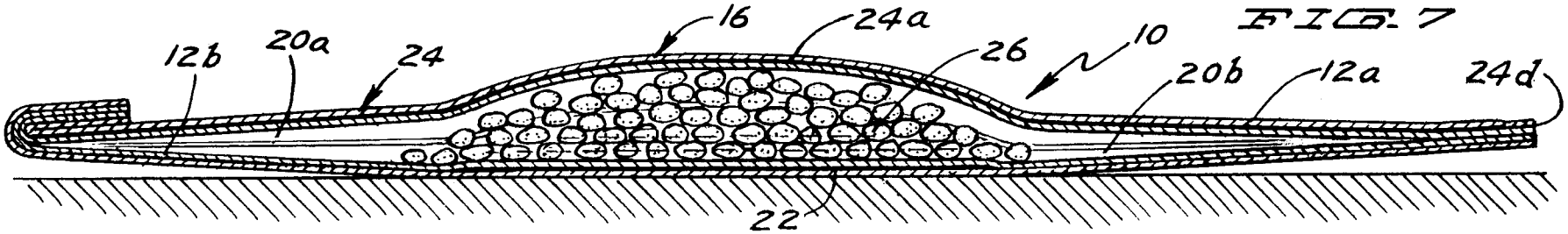
FIG. 7 is a transverse section taken in the direction of line 7—7 of FIG. 5.

At this time, reference will be made to a food product in the form of unpopped popcorn kernels 26 appearing in FIGS. 6 and 7. It will be appreciated that these kernels 26, at least the lowermost kernels, rest on the upper surface of the lower face wall 14 and thus are subjected to the greatest heat resulting from the conversion of microwave energy to thermal energy through the agency of the underlying susceptor patch 22. It will be understood that other ingredients or additions may be combined with the kernels 26, thereby constituting one form of a composite food product that may be heated in the package 16.

Figure 5:
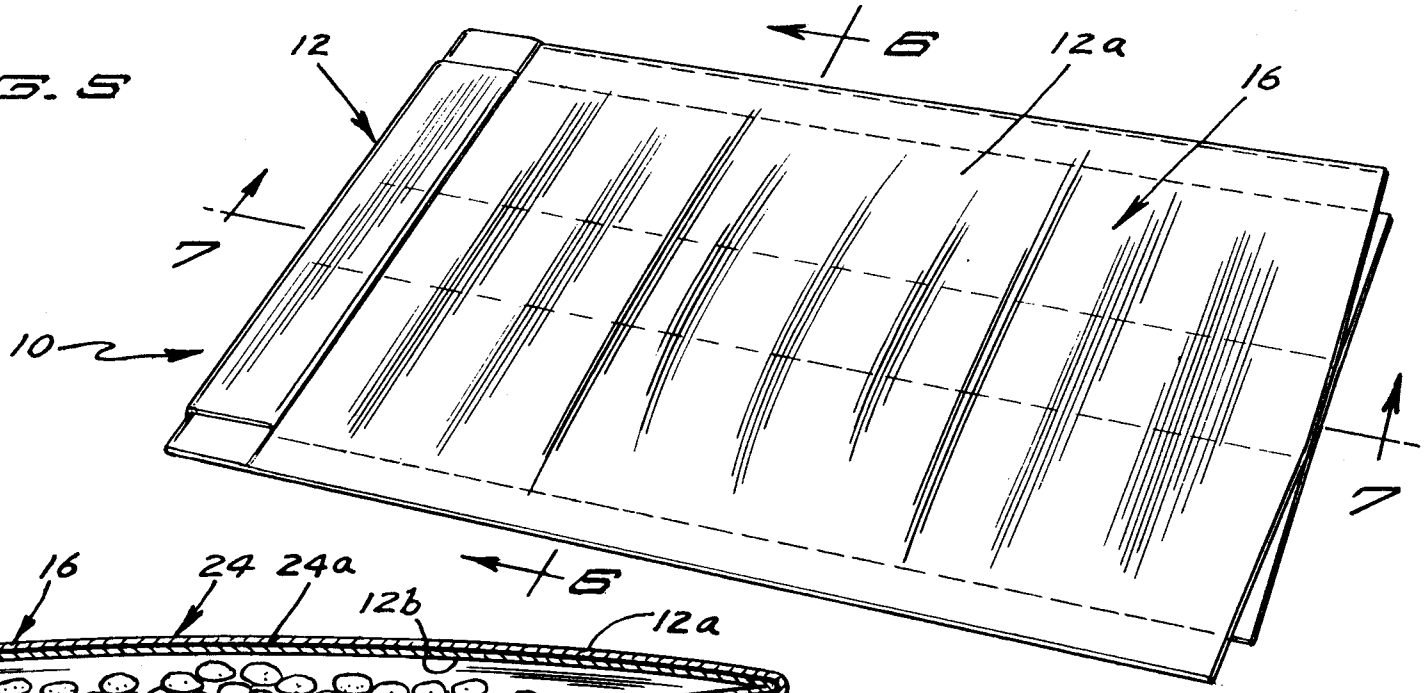
FIG. 5 is a perspective view of my popcorn package while still in its initial flat condition prior to being subjected to any microwave energy.

Inasmuch as microwave ovens are so widely used nowadays, it is not believed necessary to depict one. However, it should be recognized that the package 10 is to be placed in an oven with the susceptor patch 22 lowermost and the microwave reflective patch 24 uppermost. From FIGS. 6 and 7, it is readily apparent that the kernels 26 have not been popped because they have not yet been subjected to microwave energy, it being the function of the susceptor patch 22 to convert a portion of the microwave energy into thermal energy. Those kernels 26 resting directly over the susceptor patch 22 in FIGS. 6 and 7 will be the ones to be heated first when the oven in which the package 10 is placed is energized. As the lowermost kernels 26 pop, they are literally buoyed upwardly because of their explosive expansion and lesser density, and the pressure developed within the bag 12 causes the bag to progressively expand, doing so from the initial stage of FIGS. 5–7, through the intermediate stage of FIG. 4, and the final stage of FIGS. 1–3.

It is in the region directly beneath the patch 24 that sustains a lesser penetration of microwave energy than the lower portion of the bag 12. It will perhaps be of help to label the popped kernels with the reference numeral 26*a* in FIG. 4; it should be appreciated that this figure represents an intermediate stage in the popping cycle, so the unpopped kernels continue to be indicated by the reference numeral 26. Only a few unpopped kernels 26 remain in FIGS. 2 and 3 in that these figures illustrate the end of the popping cycle, and are pictorially indicative of the increased degree of popping achievable when practicing my invention.

Inasmuch as the microwave reflective patch 24 is opaque to microwave energy, or substantially so, it follows that considerably less microwave energy will directly impinge on the already popped kernels 26*a* than if the patch 24 were not present. The patch 24, functioning as a shield, reduces the rate of microwave bombardment on the upper level of those kernels 26*a* that have been popped.

It will be observed that the microwave reflective patch 24 is larger than the susceptor patch 22. The size of the two patches 22 and 24 may be correlated in actual practice so that there will not only be no undue heating of the popped kernels 26*a*, but that the paper bag 12 itself will remain unscorched and also that the cooking oil, usually present when the food product is popcorn, will not become discolored. Such a relationship can be easily determined in practice and the size relationship between the patches 22 and 24 selected so as to provide an optimum popping cycle where the popping cycle is shortened for a given wattage rating of whatever microwave oven is used, and at the time avoiding scorching as mentioned above. Unlike those prior art arrangements with which I am familiar, the orientation of the microwave reflective patch 24 in vertical alignment with the lower susceptor patch 22, especially when the patch 24 is dimensioned so as to overlap the lower susceptor patch 22, a far superior popped product is achieved with only a very few kernels 26 remaining unpopped. Furthermore, my invention provides an enhanced performance of the susceptor patch 22 in that a hotter temperature is reached earlier than would occur in the absence of shielding. Also, the total amount of heat generated during a given period is increased.

Figure 8:
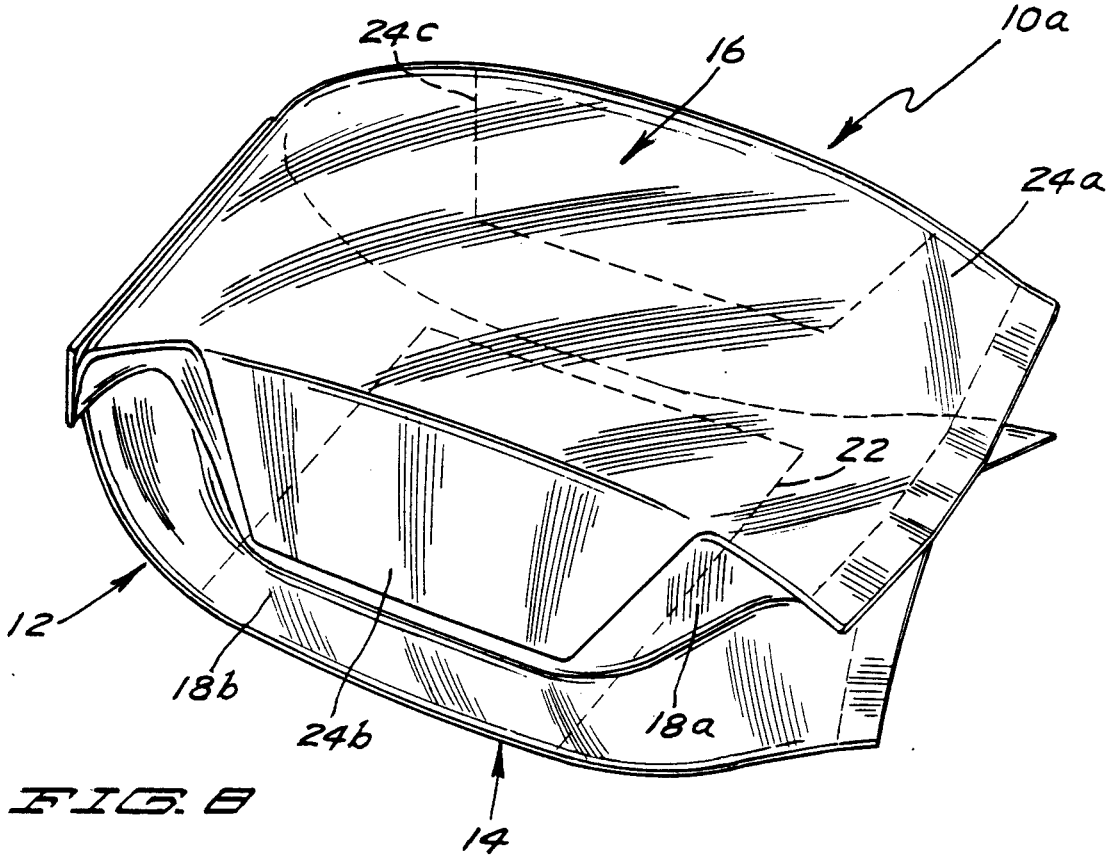
FIG. 8 is a perspective view corresponding to FIG. 1, but illustrating a modification of the package shown in FIGS. 1–7, the view being on a smaller scale, however, than FIG. 1.

At this time a brief reference will be made to FIG. 8, the difference between the embodiment of FIGS. 1–7 and what is illustrated in FIG. 8 being that the microwave reflective patch 24 in this instance constitutes a metal foil applied to the outer surface of the paper layer 12*a* rather than being sandwiched between the paper layers 12*a* and 12*b*. Since the patch 24 in FIG. 8 is intended to be functionally and structurally the same as in FIGS. 1–7, the same reference numerals have been used. Because the resulting package is somewhat different because of the patch 24 being on the outside, the modified package has been given the reference numeral 10*a*.

I claim:

1. A single cell bag containing therein popcorn kernels to be popped in a microwave oven, the bag being of flexible material generally transparent to microwave energy, the bag comprising lower and upper face walls, at least some of said kernels initially resting on said lower face wall, lower and upper side pleats, said lower face wall extending between the lower edges of said lower pleats and said upper face wall extending between the upper edges of said upper pleats, a first patch integrally associated with said lower face wall for converting at least some microwave energy to thermal energy, and a second patch integrally associated with said upper face wall for reflecting at least some microwave energy and said second patch being movable upwardly with said upper face wall as said pleats permit said bag to expand upwardly due to the popping of at least some of said kernels at a lower level in said bag where the temperature is relatively high due to heat supplied by said first patch, at least some of the popped kernels rising to an upper level where the temperature is lower due to the reflective action of said second patch.

2. A single cell bag in accordance with claim 1 in which said second patch is larger than said first patch.

3. A single cell bag in accordance with claim 2 in which said second patch is coextensive with portions of said upper pleats.

4. A package for use in a microwave oven comprising an expandable bag of flexible material generally transparent to microwave energy and having an interior constituting a single cell, said bag having lower and upper sides and said bag including upper and lower side pleats extending between said lower and upper sides, a first patch adjacent the lower side of said bag for converting at least some microwave energy to thermo energy, a second patch adjacnet the upper side of said bag for reflecting at least some microwave energy, at least a major portion of said second patch being vertically aligned with at least a major portion of said first patch when said package is placed in a microwave oven with said lower side and said first patch lowermost and said upper side and said second patch uppermost and in which said second patch is larger than said first patch, said second patch including an upper panel extending transversely between the upper edges of said upper side pleats and additional panels extending downwardly to said lower side pleats, said first patch being associated only with the lower side of said bag and said second patch being larger than said first patch.

* * * * *